US008017880B2

(12) United States Patent
Eisenhower, Jr. et al.

(10) Patent No.: US 8,017,880 B2
(45) Date of Patent: Sep. 13, 2011

(54) SAFETY SWITCH

(75) Inventors: Gary Eisenhower, Jr., Freeport, IL (US); Jeffrey S. Hall, Winnebago, IL (US)

(73) Assignee: Honeywell International Inc., Morristown, NJ (US)

( * ) Notice: Subject to any disclaimer, the term of this patent is extended or adjusted under 35 U.S.C. 154(b) by 575 days.

(21) Appl. No.: 12/147,228

(22) Filed: Jun. 26, 2008

(65) Prior Publication Data

US 2009/0321226 A1 Dec. 31, 2009

(51) Int. Cl.
*H01H 9/20* (2006.01)

(52) U.S. Cl. ..... 200/43.04; 200/43.01

(58) Field of Classification Search .... 200/43.01–43.22, 200/50.01–50.04, 318–327, 17 R, 334, 47–49
See application file for complete search history.

(56) References Cited

U.S. PATENT DOCUMENTS

| | | | | |
|---|---|---|---|---|
| 5,861,786 | A * | 1/1999 | Laveau | 335/132 |
| 5,868,243 | A * | 2/1999 | Bachle | 200/334 |
| 6,013,881 | A | 1/2000 | Hall et al. | |
| 6,307,167 | B1 * | 10/2001 | Kajio et al. | 200/43.11 |
| 6,872,898 | B2 * | 3/2005 | Mohtasham | 200/43.01 |
| 7,332,989 | B2 * | 2/2008 | Jones | 335/132 |

* cited by examiner

*Primary Examiner* — Renee S Luebke
*Assistant Examiner* — Marina Fishman
(74) *Attorney, Agent, or Firm* — Ingrassia Fisher & Lorenz, P.C.

(57) ABSTRACT

An operating head (11) for a safety switch (100) includes a key-operated cam mechanism (12) and a plunger (27) contacting the cam mechanism (12) and extending from the cam mechanism (12). In the safety switch (100), the plunger (27) is displaceable between first and second positions responsive to the cam mechanism (12). The safety switch (100) further includes at least one securing member (127) interacting with the plunger (27) and displaceable between a locked and a released position. When the securing member (127) is in the released position, movement of the plunger (27) is allowed. When the plunger (27) is in the second position, the securing member (127) is displaced from the released position to the locked position, which secures the plunger (27) in the second position.

16 Claims, 12 Drawing Sheets

SAFETY SWITCH

FIELD OF THE INVENTION

The present invention is directed to the field of key operated safety switches, and more particularly to operating heads for key operated safety switches.

BACKGROUND

Limit switches are typically designed for use on machines with removal of a key bringing the machine to an immediate safe (de-energized) condition. Such switches provide enhanced operator safety when added to hinged or sliding guard doors, screens, or protective covers for enclosures. Such limit switches are typically well suited for industrial applications to cause the de-energizing of equipment in a manufacturing plant. Generally, such limit switches need to be constructed using heavy duty materials and methods to ensure their reliable operation in typically harsh manufacturing environments.

One typical difficulty with such limit switches is that keys can inadvertently be repositioned within the limit switch or altogether dislodged from the limit switch, causing an unexpected deactivation of the machinery. Such events are typically are the result of machinery vibrations causing motion of the key or by keys inadvertently catching on operator clothing or other moving objects. In some cases wear or misalignment of machinery, key, or switch components can increase the likelihood of such events. Therefore, there exists a need for limit switches which are resistant to inadvertent repositioning or dislodgement of keys.

SUMMARY OF THE INVENTION

This Summary is provided to comply with 37 C.F.R. §1.73, requiring a summary of the invention briefly indicating the nature and substance of the invention. It is submitted with the understanding that it will not be used to interpret or limit the scope or meaning of the claims.

In a first embodiment of the present invention, an operating head for a safety switch is provided. The operating head can include a key-operated cam mechanism and a plunger contacting the cam mechanism. The plunger can extend from the cam mechanism and is displaceable responsive to the cam mechanism. The operating head also can include at least one securing member interacting with the plunger and displaceable between locked and released positions. When the securing member is in the released position, movement of the plunger is allowed. When the plunger is in the second position, the securing member is displaced from the released position to the locked position, which secures the plunger in the second position.

In a second embodiment of the present invention, a safety switch is provided. The safety switch can include a cam housing for housing a key-operated cam mechanism, a securing housing coupled to the cam housing, and a switch housing having a switch mechanism coupled to the securing housing. The safety switch can also include a plunger contacting the cam mechanism and the switch mechanism and extending through the securing housing. The plunger is displaceable between first and second positions responsive to the cam mechanism and actuates the switch mechanism. The safety switch can further include at least one securing member extending through at least a portion of the securing housing and interacting with the plunger within the securing housing, where the securing member is displaceable between locked and released positions. When the securing member is in the released position, movement of the plunger is allowed. When the plunger is in the second position, the securing member is displaced from the released position to the locked position, which secures the plunger in the second position.

In a third embodiment of the present invention, a safety enclosure is provided. The safety enclosure can include a first enclosure portion having a key-operated safety switch and a second enclosure portion for engaging the first enclosure portion. The second enclosure can having a key for the safety switch, where the key is oriented to engage the safety switch during engagement of the first and the second enclosure portions. The safety switch can include a key-operated cam mechanism, a switch mechanism, and a plunger contacting the cam mechanism and extending from the cam mechanism to the switch mechanism. In the safety switch, the plunger is displaceable between first and second positions, responsive to the cam mechanism, for actuating the switch mechanism. The safety switch can further include at least one securing member interacting with the plunger and displaceable between locked and released positions. When the securing member is in the released position, movement of the plunger is allowed. When the plunger is in the second position, the securing member is displaced from the released position to the locked position, which secures the plunger in the second position.

DETAILED DESCRIPTION

Figure 1:
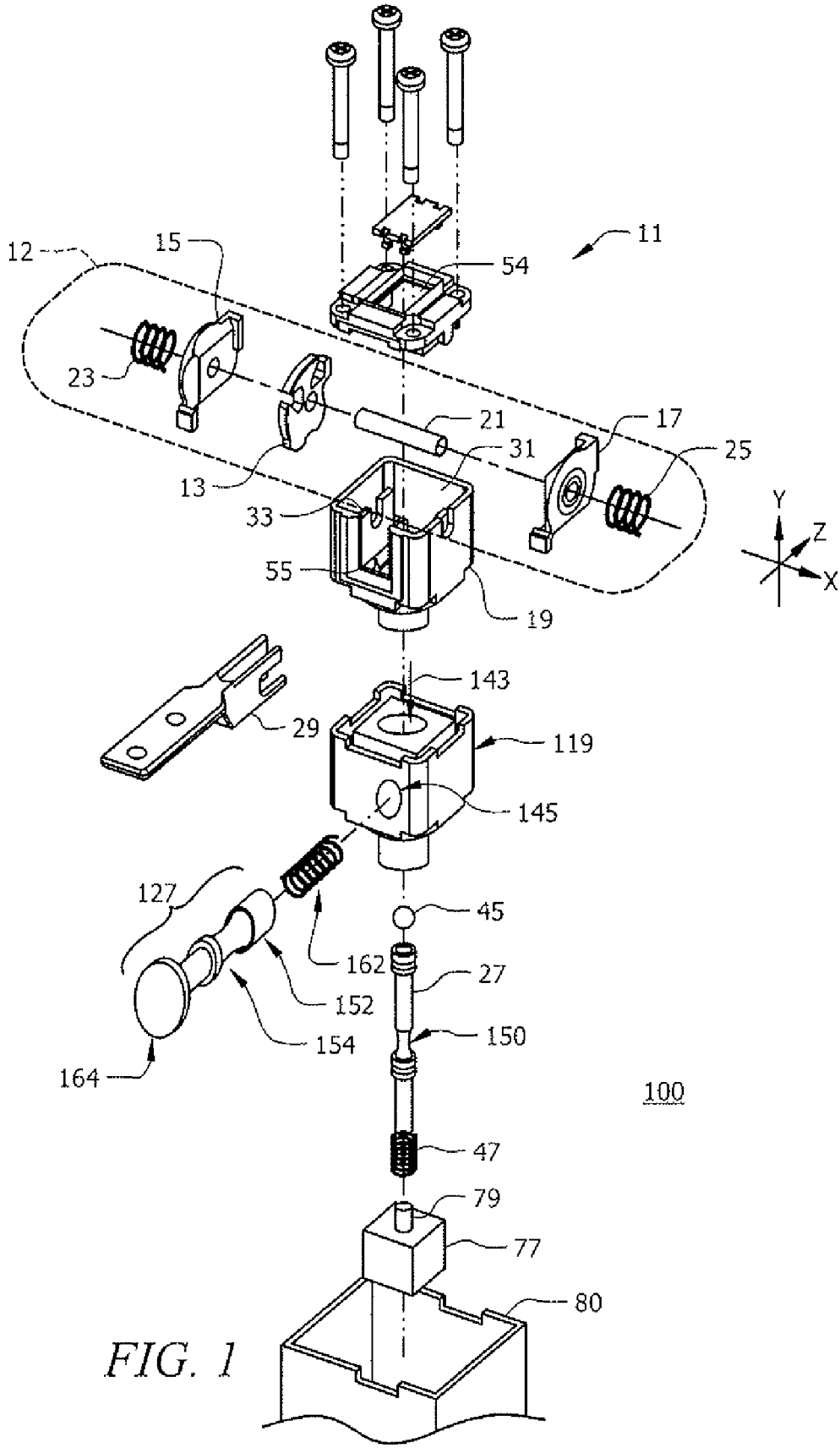
FIG. 1 is an exploded perspective view of an operating head assembly and its contact block according to an embodiment of the present invention.

The present invention is described with reference to the attached figures, wherein like reference numerals are used throughout the figures to designate similar or equivalent elements. The figures are not drawn to scale and they are provided merely to illustrate the instant invention Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The invention will now be described more fully hereinafter with reference to accompanying drawings, in which illustrative embodiments of the invention are shown. This invention, may however, be embodied in many different forms and should not be construed as limited to the embodiments set forth herein.

Embodiments of the present invention provide a key-operated safety switch for machinery that is resistant to inadvertent de-energizing due to unintentional displacement of the key. In particular, embodiments of the present invention provide an operating head for a key-operated safety switch including a locking mechanism for preventing displacement of a switch plunger due to unintentional displacement of the key. As used herein, "unintentional displacement of the key" refers to motion of the key while engaged with an operating head of the safety switch. That is, motion that is sufficient for displacement of the switch plunger in the safety switch without causing removal of the key from the safety switch. As previously described, such motion can occur as a result of wear, vibrations, interaction with objects, or any combination thereof. In the various embodiments of the present invention, the locking mechanism is provided by use of a displaceable locking member biased against the surface of a plunger shaft, where the profiles of the surfaces of the locking member and the plunger shaft are selected to lock the plunger shaft in place when the key is engaged with the operating head until the locking member is displaced.

Although the various embodiments of the present invention will be described with regards to the exemplary switch plunger mechanism described in FIG. 1-13, the present invention is not limited in this regard. One of ordinary skill in the art will recognize that the various systems and methods described herein are equally applicable and adaptable to any other safety switch employing a different plunger-type mechanism.

FIGS. 1-4 show various views of an operating head 11 for a key-operated safety switch 100 according to an embodiment of the present invention. As seen in FIGS. 1-4, the operating head 11 comprises a cam housing 19 and a securing housing 119, where the operating head 11 can be configured to accept a key 29 for causing a plunger 27 to be displaced along a direction in the Y axis. As shown in FIG. 1, the cam housing 19 can house a cam mechanism 12 including a cam 13, left and right locking members 15, 17, respectively, a shaft 21, and left and right locking member biasing means 23 and 25, respectively. She cam housing 19, as seen in FIG. 1 and in perspective and partial top view in FIG. 5 (without cam 13), can define a central cavity 31 containing an axle bearings 33. Because the left and right sides of the cam housing 19 are generally mirror images along the X axis, only one half of the cam housing 19 and cam mechanism 12 therein will be described throughout this description, unless otherwise indicated.

Figure 6:
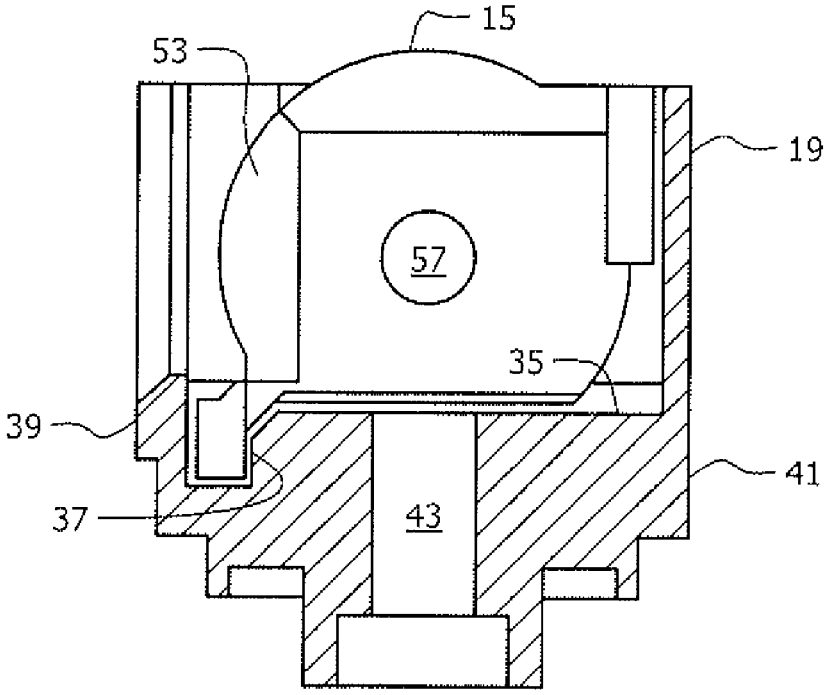
FIG. 6 is a cross section of the housing and locking member along lines V-V of FIG. 4.

As seen in the cross sectional view of FIG. 6, the cam housing 19 can further contain surfaces or bosses 35, 37 for the non-rotatable support of the locking member 15. Frontwall 39, and backwall 41 can further provide bearing surfaces for locking member 15 in order that the locking member be non-rotatably supported. The cam housing 19 can also have a plunger cavity 43 extending in the Y axis for allowing up and down movement of the plunger 27 in response to the activation thereof by the cam 13. As seen in FIG. 1, a ball bearing 45 can be used to interface between the cam 13 and the plunger 27. In other embodiments, the plunger 27 can be biased against the cam 13 by a spring, a lever, and/or other means of applying force to the plunger 27 to cause its motion.

Figure 2:
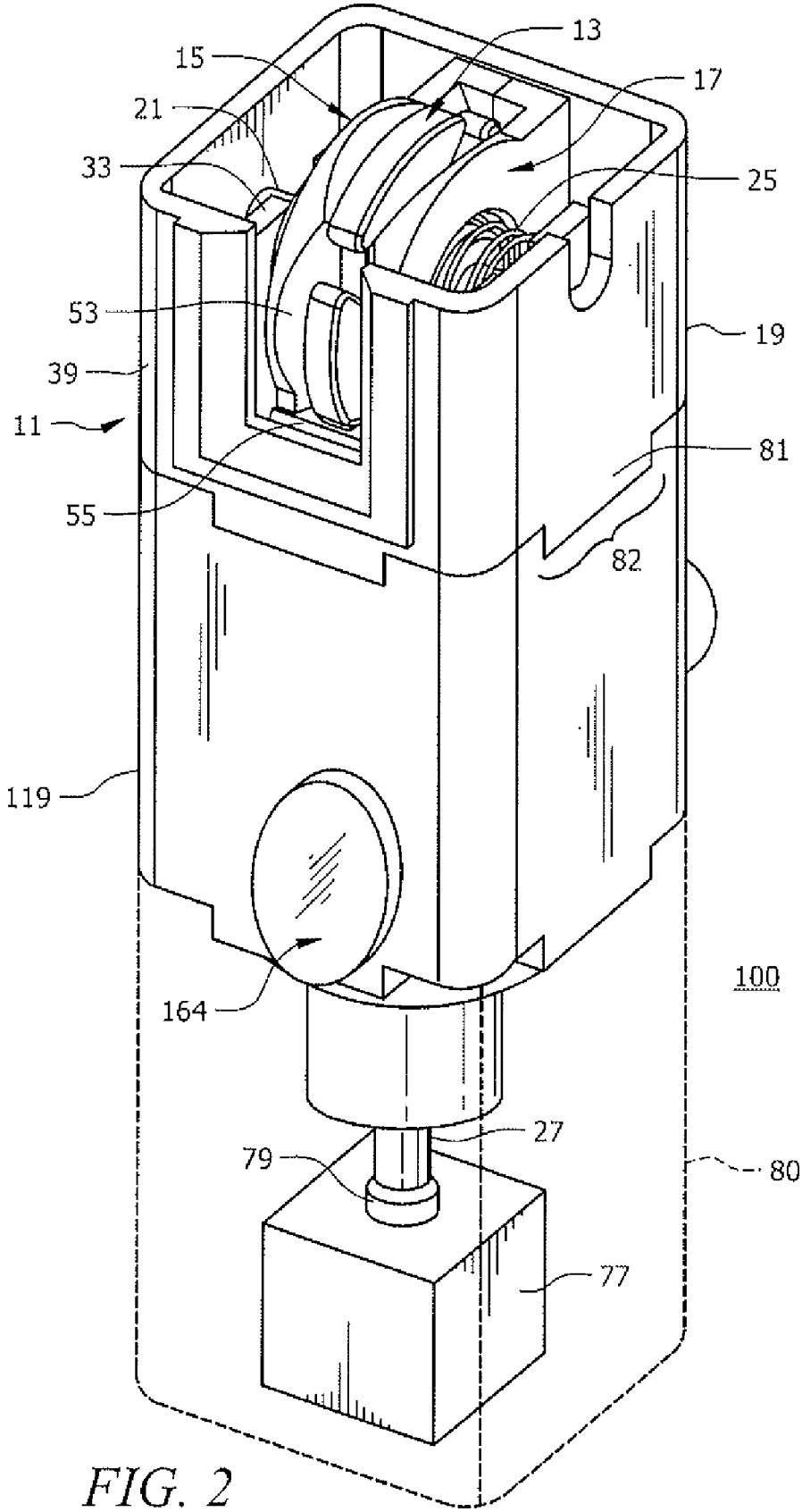
FIG. 2 is a perspective view of an operating head with the cover off and in the unlocked position according to an embodiment of the present invention.
Figure 3:
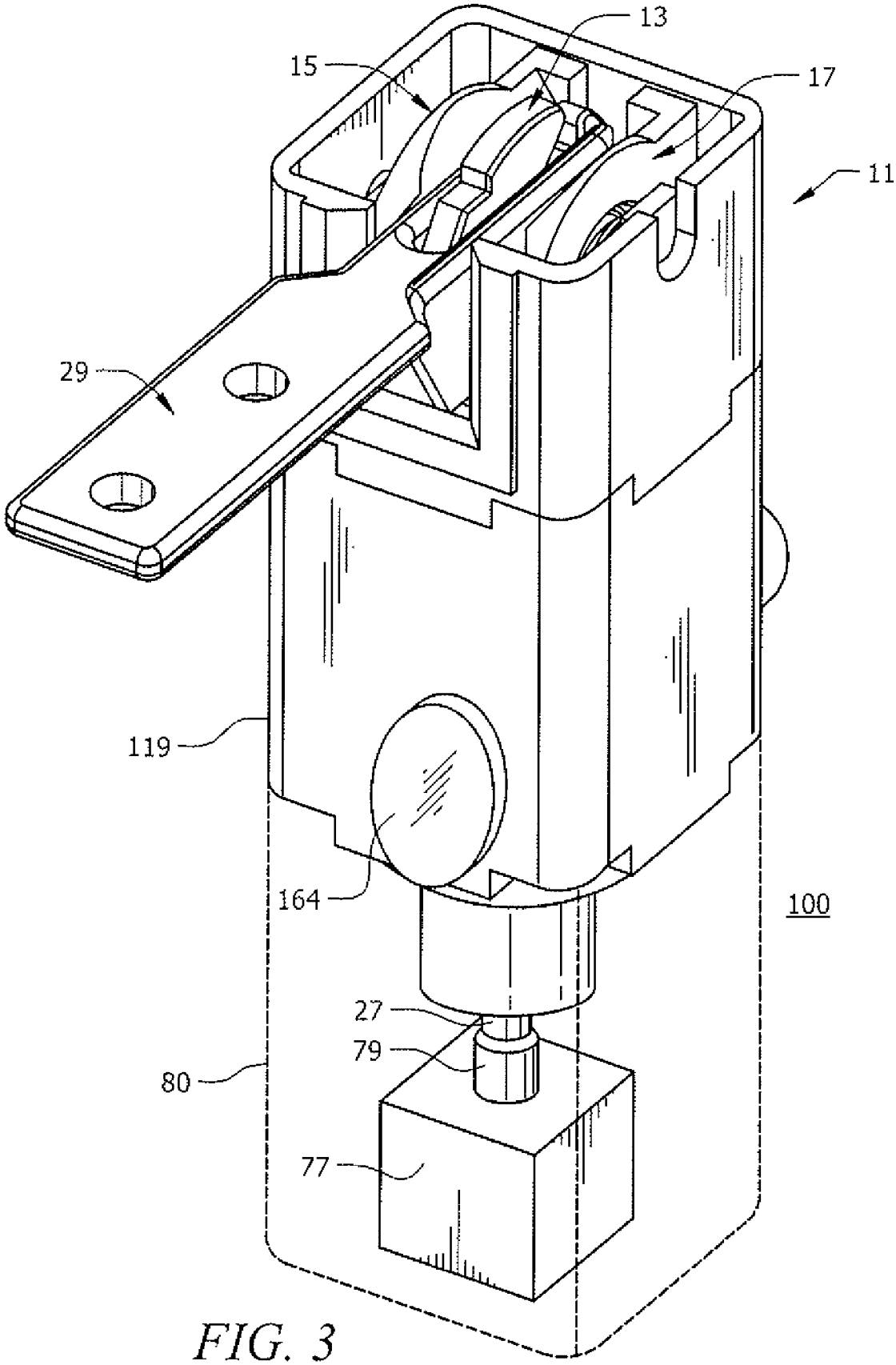
FIG. 3 is a perspective view of the operating head with the cover off and in the locked position with the key fully inserted according to an embodiment of the present invention.
Figure 4:
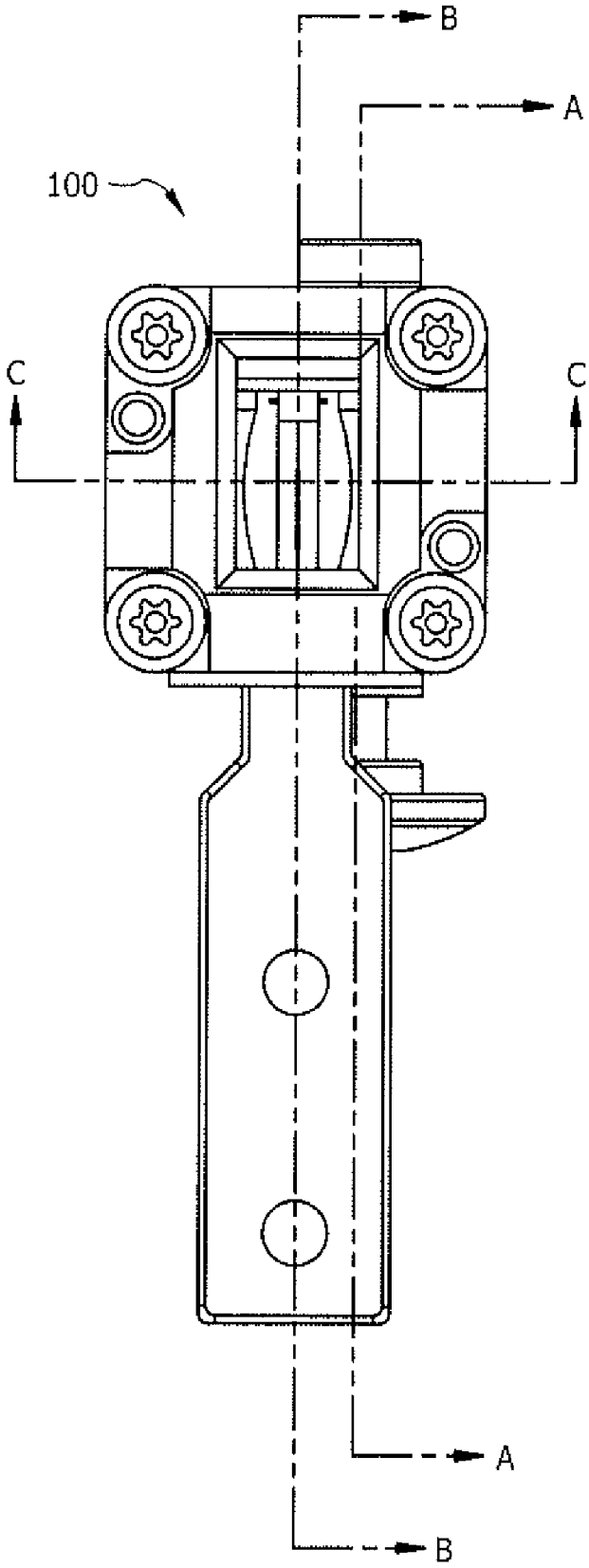
FIG. 4 is a top view of the operating head with the key fully inserted according to an embodiment of the present invention.
Figure 5:
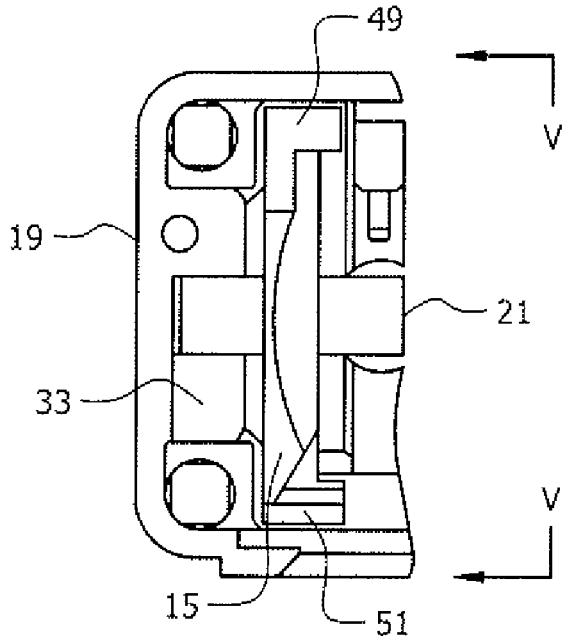
FIG. 5 is a top partial view of the left side locking member placed within the housing according to an embodiment of the present invention.
Figure 7:
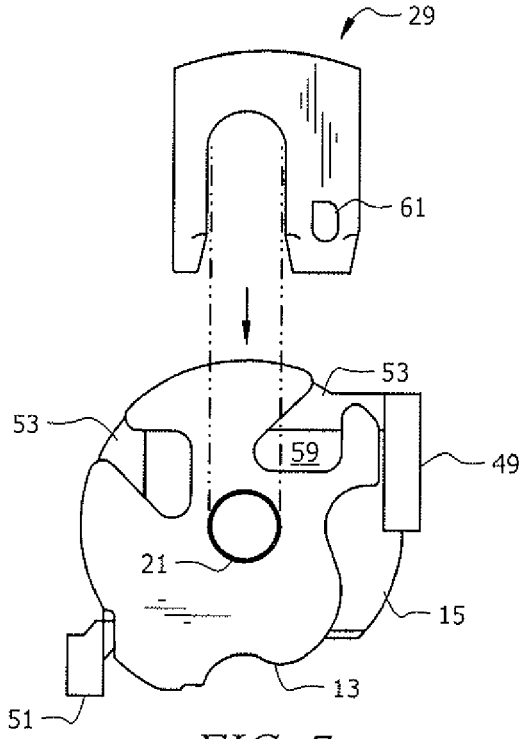
FIG. 7 is a detail side view of the cam, locking member and key according to an embodiment of the present invention.
Figure 8:
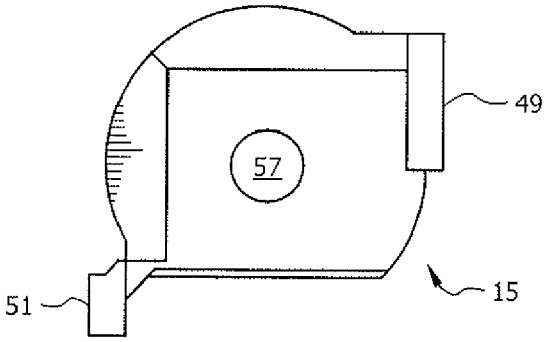
FIG. 8 is a detail side view of a locking member according to an embodiment of the present invention.

Referencing FIGS. 2, 7, and 8, the left locking member 15 can abut cam 13 in the locked position, the locking member being biased towards the center position and cam 13 by biasing spring 23. Left and right locking members 15, 17 respectively, can be biased to abut together and surround cam 13 when in the locked, or key removed, position.

Figure 9:
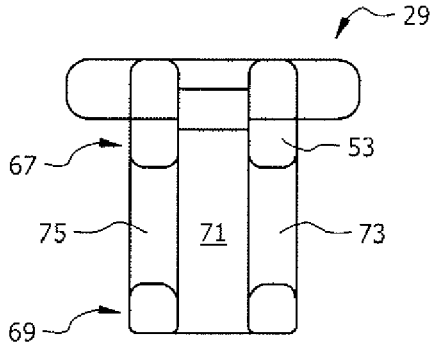
FIG. 9 is a front view of the key according to an embodiment of the present invention.
Figure 10:
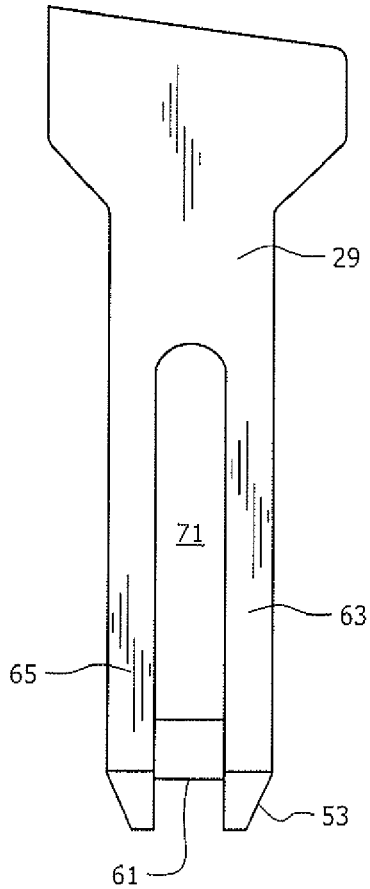
FIG. 10 is a top view of the front portion of the key according to an embodiment of the present invention.

Referencing FIGS. 7 and 8, the locking member 15 can have a back side top lock block 49 and a front side bottom lock block 51 which can abut the cam 13 in the locked position to prevent its rotation about shaft 21. Locking member 15 can have a radiused or beveled face 53 presented to the keyhole opening 55 in cam housing 19. The beveled face 53 permits acceptance of the beveled front end of key 29 as seen in FIGS. 7, 9, and 10. There can also be a top beveled surface on the locking member for top-side key entry because the cam mechanism 12 does not change positions from that shown. The key porthole can be merely uncovered at the top of the operating head. The locking members of the exemplary embodiment are further provided with an opening 57 for slidable mounting in the X axis on shaft 21.

The cam 13, as seen in FIG. 7, can be fitted with a key crossbar-accepting cutout 59 and suitable plunger actuation surfaces. Referencing FIGS. 3, 7, 9, and 10, when the key 29 can be inserted through keyhole 55, it can spread locking members 15 and 17 laterally away from the cam along the X axis, thereby removing lock blocks 49, 51 from contact with the cam 13, allowing cam 13 to rotate. Rotation can be caused by a crossbar member 61 which spans the top two tines 63, 65 of the key 29. The key 29 can be equipped with four tines arranged in upper and lower pairs 67, 69 respectively with the right and left sides spaced apart by a central channel 71 which permits the cam 13 to enter therein. However, the invention is not limited in this regard and any number of tines can be used in the various embodiments of the present invention.

Upper and lower tined pairs 67, 69 can be further separated by side channels 73, 75 which allow key travel over, or around, the shaft 21. It will be appreciated that full insertion of both pairs of tines 67, 69 are used to fully release locking member lock blocks which are positioned at the upper back and lower front of the locking means. Cross member 61 can then engage the cam crossbar cutout 59 to rotate the cam to the unlocked position whereby plunger 27 can be released.

This can allow contact block actuator 79 of contact block 77 to be released and allow the normally closed contacts of the switch mechanism within a switch housing 80 to permit flow of electricity to a device.

Although the cam mechanism 12 within the exemplary cam housing 19 causes displacement of the plunger 27, any subsequent movement of the key 29 can cause the cam 13 to rotate. Such rotation, even if minor, can cause the displacement of the plunger 27, the contact block actuator 79, and the contact block 77, resulting in opening of the normally closed contacts (not shown) of the safety switch 100, disrupting the flow of electricity to the device being powered.

Accordingly, as shown in FIG. 1, at least one securing member 127 can be provided to engage with the plunger 27 within a securing housing 119. That is, the securing housing 119 can be positioned to surround a portion of the plunger 27 extending from the cam housing 119. In particular, the securing housing can have a plunger cavity 143 extending along the Y axis for allowing up and down movement of the plunger 27 in response to the activation thereof by the cam 13, as previously described. The securing housing 119 can have at least one securing member cavity 145 extending in a direction that is substantially perpendicular relative to or normal to the direction of plunger cavity 143. For example, as shown in FIG. 1, the securing member cavity 145 can extend along the Z axis. In the various embodiments, at least a portion of the securing member cavity 145 intersects at least a portion of the plunger cavity 143 to permit the plunger 27 and the securing member 127 to interact. As used herein, "substantially perpendicular" refers to an orientation of 90 degrees+/−5 degrees. The securing member 127 can be coupled to a button 164 or other actuator for adjusting a position of the securing member 127.

Although the exemplary embodiment shows the securing member cavity 145 and the plunger cavity 143 in the securing housing 119 being substantially perpendicular, the present invention is not limited in this regard. For example, in some embodiments, the direction of securing member cavity 145 can have an orientation that is not substantially perpendicular to or normal to the direction of plunger cavity 143. In such embodiments, the orientation of the direction of securing member cavity 145 and the direction of plunger cavity 143 can be separated by an angle that is less than 90 degrees, such as 60, 45, or 30 degrees.

In the various embodiments of the present invention, one or more surface features on the plunger 27, the securing member 127, or both are provided to lock the plunger 27 in place once a key 29 has been inserted in the cam housing 19. For example in the case of a cylindrical plunger 27 and a cylindrical securing member 127, as shown in FIG. 1, the plunger 27 can include an annular shoulder portion 150. However, the invention is not limited in this regard and a non-annular shoulder portions can also be used. In such embodiments, additional components or configuration of the plunger 27 and/or the securing housing 119 can be required to ensure proper alignment of the plunger 27 with respect to the securing member. However, use of annular shoulders can simplify the design and operation of such operating heads by not requiring such alignment structures.

Figure 11:
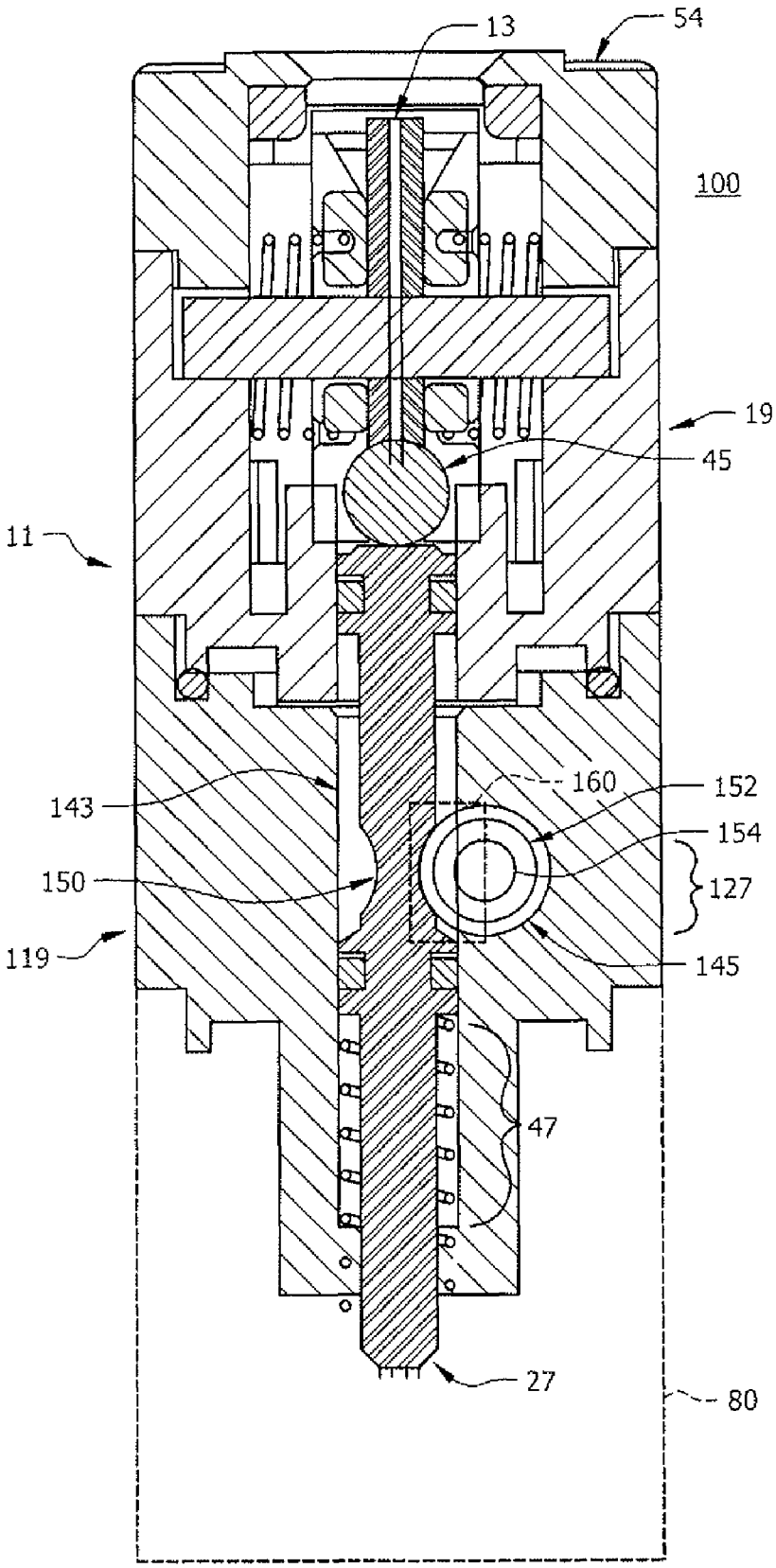
FIG. 11 is a cross section of the operating head in FIG. 4 along lines C-C.
Figure 12:
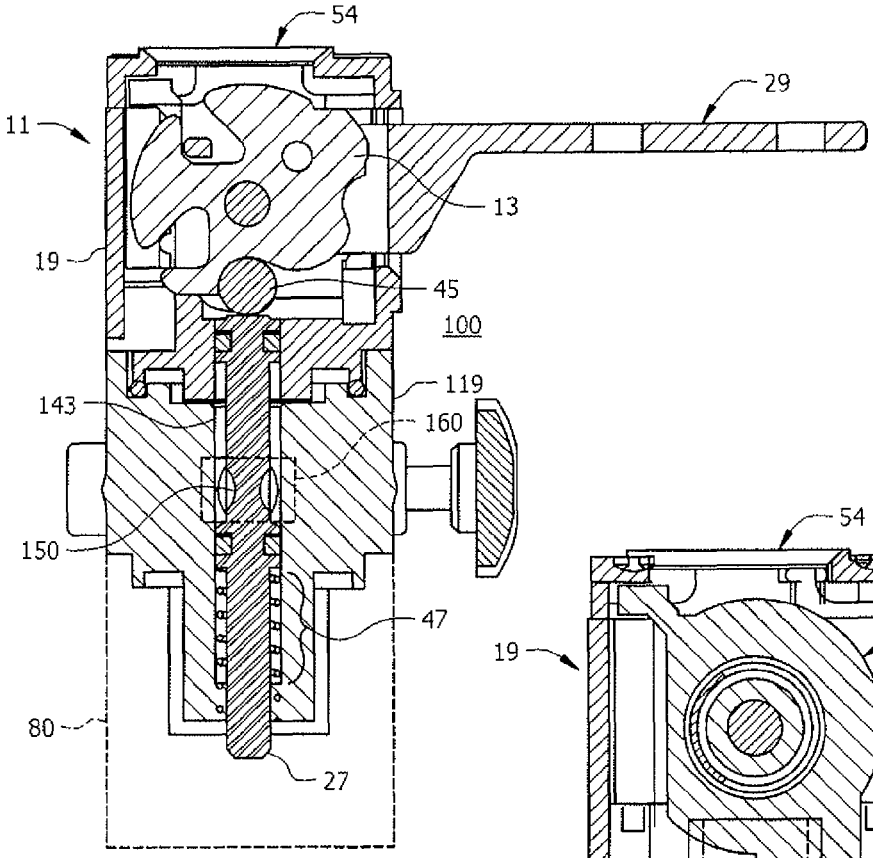
FIG. 12 is a cross section of the operating head in FIG. 4 along lines B-B.

The annular shoulder portion 150 can be configured to engage with a portion of the securing member 127 in the intersecting portion 160 of the plunger cavity 143 and securing member cavity 145, as shown in FIGS. 11 and 12. In particular, the annular shoulder portion 150 can be dimensioned such that when the annular shoulder portion 150 is in the intersecting portion 160, a cylindrical portion 152 of the securing member 127 retains the plunger 27 in place when the cylindrical portion 152 is also in the intersecting portion 160. For example, the annular shoulder 150 and the cylindrical portion 152 can have approximately the same dimensions. This is illustratively shown in FIG. 11.

As shown in the cross-section shown in FIG. 11, the plunger cavity 143 and the securing member cavity 145 intersect in portion 160 of the securing housing 119. In FIG. 11, if the annular shoulder portion 150 of the plunger 27 is within intersecting portion 160 and the securing member 127 can be positioned with a cylindrical portion 152 in this intersecting portion 160, the securing member 127 prevents further motion of the plunger 27. Accordingly, while the securing member 127 is thusly positioned, motion of the plunger 27 can be limited only the amount of play due to the dimension of the plunger 27, the securing member 127, the plunger cavity 143, and the securing member cavity 145. Consequently, motion of the plunger 143 can be further limited by more precise manufacture of these components. The amount of precision required may be limited by the amount of motion required for the plunger 27 before the switch can be disengaged. However, the present invention is not limited to shoulder portions matching the dimensions of the surface engaging the shoulder.

For example, in embodiments where the plunger 27 and the securing member 127 are cylindrical, the shoulder portion 150 of the plunger 27 the plunger having a constant smaller diameter than other portions and a length equal to the width of the portion of the securing member 127 in the intersecting portion 160. Accordingly, when the shoulder portion 150 is in the intersecting portion 160, the plunger 27 can still be prevented from moving, even if the shoulder 150 and the securing member have different profiles.

To allow subsequent and intentional motion of the plunger 27 (such as when purposely disengaging key 29 from the cam housing 19), the securing member 127 can also include an annular shoulder portion 154. The annular shoulder portion 154 can be dimensioned such that when the annular shoulder portion 150 is in the intersecting portion of the plunger cavity 143 and securing member cavity 145, the plunger 27 is free to move in the plunger cavity 143. For example, as described above with respect to the annular shoulder 150 in the plunger 27, the annular shoulder 152 in the securing member and other portions of plunger 27 traveling through the securing housing can have approximately the same dimension. This is also illustratively shown in FIG. 11. As described above with respect to FIG. 11, the plunger cavity 143 and the securing member cavity 145 intersect in portion 160 of the securing housing 119. If the annular shoulder portion 154 of the securing member 127 is positioned within intersecting portion 160, the annular shoulder portion 154 of the securing member will not engage with the plunger 27, allowing motion of the plunger 27.

Although the plunger 27 and the securing member 127 in the exemplary embodiment described above are both cylindrical and include annular shoulder portions, the present invention is not limited in this regard. For example, in some embodiments, the plunger 27, the securing member 127, or both can be non-cylindrical. In other embodiments, non-annular shoulders can be used. However, as previously described additional configuration of the plunger 27, the securing member 127, and/or the securing housing can be required to align non-annular shoulders reliably.

Although motion of the plunger 27 can be allowed or restricted based on the position of the securing member 127, in the various embodiments of the present invention, in some embodiments, it may be desirable to provide a securing mechanism that automatically secures the plunger 27 after the key 29 can have been inserted in the cam housing 19. For example, as shown in FIGS. 1 and 13, the securing member 127 can be configured to cooperatively operate with a spring member 162 to automatically reposition the securing member 127 upon motion of the plunger 27.

Figure 13:
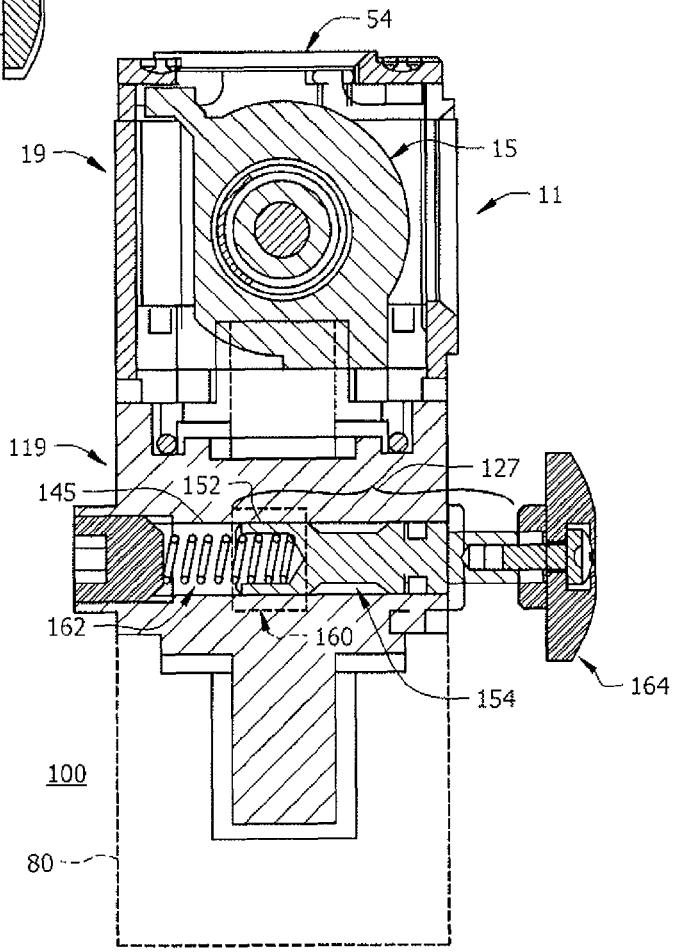
FIG. 13 is a cross section of the operating head in FIG. 4 along lines A-A.

For example, as shown in FIG. 13, a spring member 162 can be placed in the securing member cavity 145 along with the securing member 127 to cause the securing member 127 to be automatically repositioned from a release position to a locked position. In particular, a spring member 162 can be configured to automatically reposition the cylindrical portion 152 of the securing member 127 in the intersecting portion 160 of the securing housing when the annular shoulder portion 150 of the plunger 27 is in the intersecting portion 160. That is, in the case of a compression spring, the force of the spring member 162 is used to cause motion of the securing member 127 when the securing member 127 is free to move in the securing member cavity 145. Accordingly, by forcing the cylindrical portion 152 of the securing member 127 into the intersecting region 160, no further motion of the plunger 127 is allowed.

Afterwards, to release the plunger 27 and remove the key 29 from the cam housing 19, force can be exerted by an operator on the securing member 127. The force is used to compress the spring member 162 and reposition the annular shoulder portion 154 of the securing member 127 in the intersecting portion 160 of the securing housing 119. Accordingly, as described above, motion of the plunger 27 is then permitted, allowing the operator to remove the key 29 and de-energize the device. In such embodiments, a button 164 or other actuating device can be used by the operator, as shown in FIGS. 1-4 and 12-14B.

In some embodiments of the present invention, the orientation of the cam housing 19 and the securing housing 119 can be altered with respect to each other and to the switch housing. For example, in the embodiment illustrated in FIG. 1, the cam housing 19, the securing housing 119, and the switch housing 80 can include engagement features for allowing rotation of at least one of housings 19 and 119 without affecting operation of the switch mechanism of the switch housing 80. Operation of the plunger 27 and the locking member 127 are not affected since orientation of the member cavity 143 to the securing member cavity is still preserved. In particular, as shown in FIG. 2, the cam housing 19 and the securing housing 119 can include mated slots 81 and tabs 82 positioned symmetrically about the engaging portions the cam housing 19 and the securing housing 119. A similar set of slots and tabs can be provided for the engaging portions of the securing housing 119 and the switch housing 80. Thus, in the exemplary embodiment in FIGS. 1-13, the orientation and position of the button 164 and the keyhole opening 55 can be adjusted for the particular mounting position for the safety switch 100. In particular, each housing 19 and 119 can be rotated in increments of approximately 90 degrees about the Y-axis and the plunger 27.

Figure 14A:
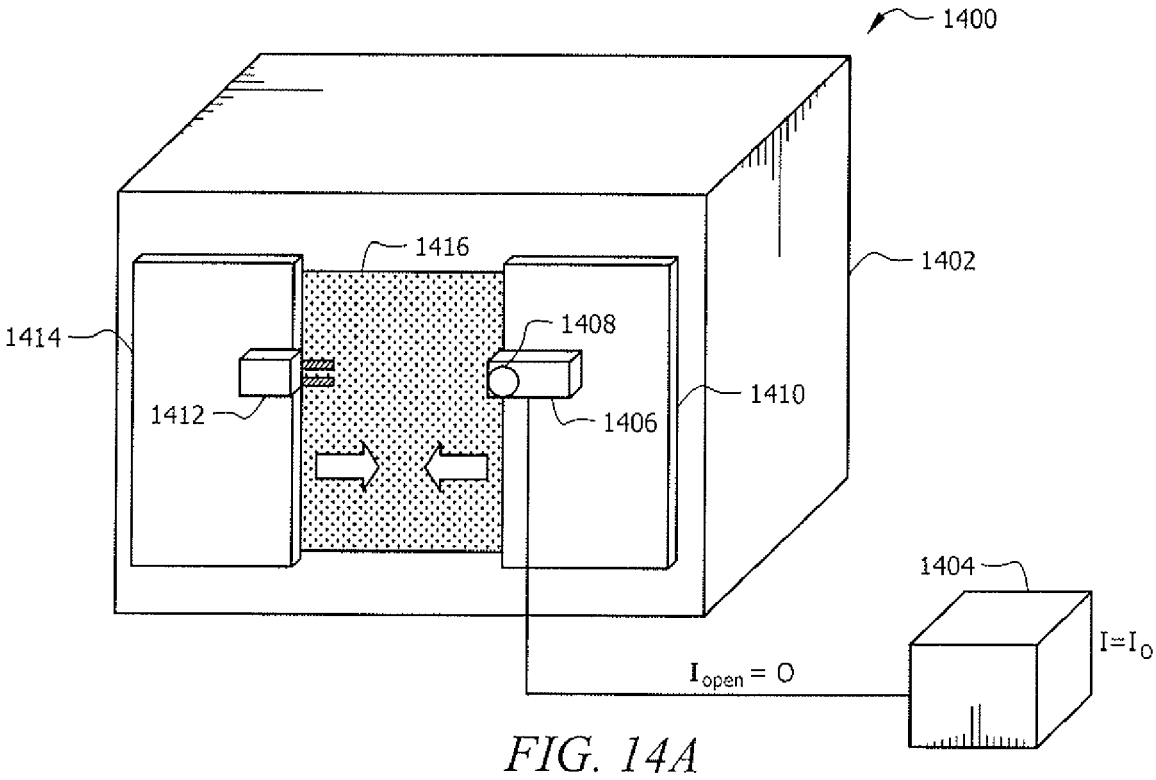
FIG. 14A is a perspective view of an enclosure in an open state utilizing a safety switch according to an embodiment of the present invention.
Figure 14B:
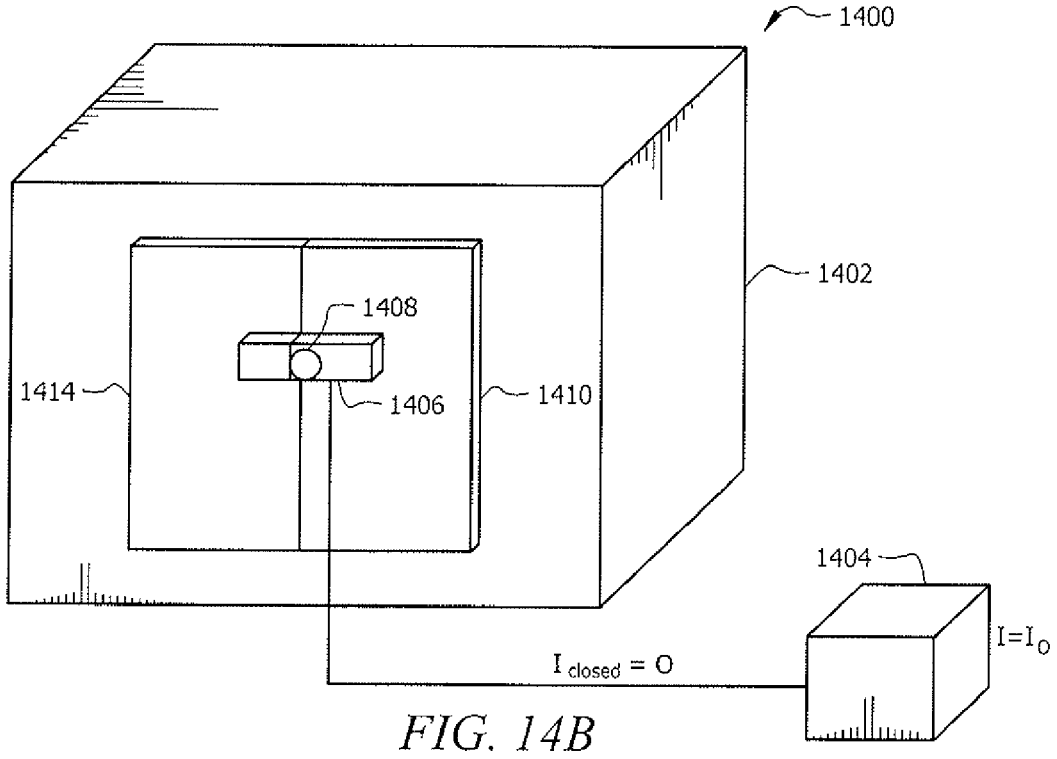
FIG. 14B is a perspective view of an enclosure in a closed state utilizing a safety switch according to an embodiment of the present invention.

FIGS. 14A and 14B show a safety enclosure 1400 for an electrical device according to an embodiment of the present invention. The enclosure 1400 can include a main body portion 1402 for enclosing a electrical device operating therein power by a power supply 1404. Although the power supply 1404 is shown in FIGS. 14A and 14B as being external to the main body 1402, one of ordinary skill in the art will recognize that the power supply 1404 can also be installed with the main body 1402. In the various embodiments, current from the power supply is controlled by a safety switch 1406 having a button or actuator, as previously described with respect to the safety switch 100 described with respect to FIGS. 1-13. The safety switch 1406 can be mounted on a first portion of the main body 1402. As shown in FIGS. 14A and 14B, the switch 1406 is mounted on a first sliding door portion 1410. As previously described, a key 1412 can be used to change switch 1406 from a current blocking state to a current conducting state. The key 1412 can be mounted on a second sliding door portion 1414. The first 1410 and second 1414 sliding door portions can be configured so that when they cover an opening of the main body portion 1402, the key 1412 and the switch 1406 engage.

The switch 1406 is configured to be in a current blocking state when the key 1412 is not engaged with the switch 1406. That is when at least one of the door portions 1410, 1414 is open, current from the power supply 1404 is zero ($I_{OPEN}=0$). The enclosure 1400 is shown in such a state in FIG. 14A. Accordingly when both door portions 1410, 1414 are closed, the key 1412 engages the switch 1406 and the switch 1406 is switched to a current conducting state ($I_{CLOSED}=I_O$). The enclosure 1400 is shown in such a state in FIG. 14A. As previously described with respect to the safety switch 100 in FIGS. 1-13, in safety switch 1406, to disengage the key 1412, de-energize any devices in the enclosure 1400, and open the door portions 1410, 1414, the operator can first press button 1408 to release the plunger therein. In the enclosure 1400, the button allows the door potions 1410, 1414 to separate.

Although a single exemplary configuration of the use of the various embodiments of a safety switch has been described above, the present invention is not limited in this regard. A safety switch, in accordance with the various embodiments of the present invention, can be used for any type of entryway, including hinged or slidable doors, windows, gates, or other barrier devices. The various embodiments of the safety switch can also be used between a non-moving portion and a moving portion. For example, the two door portions 1410, 1414 in FIG. 14 can be replaced with a single door portion over opening 1416. In such embodiments, the switch 1406 can instead be mounted on the main body 1402 and the key 1412 can be mounted on the single door, where the single door can the main body 1402 are configured to engage such that the result is the key 1412 being inserted into the switch 1406.

Although the exemplary embodiments described above, requires an operator to press the button in the safety switch to disengage a key, the invention is not limited in this regard. In some embodiments, the configuration of the spring member, the securing member, and the securing housing can be altered to require an operator to pull on a button. This is described below with respect to FIG. 15.

Figure 15:
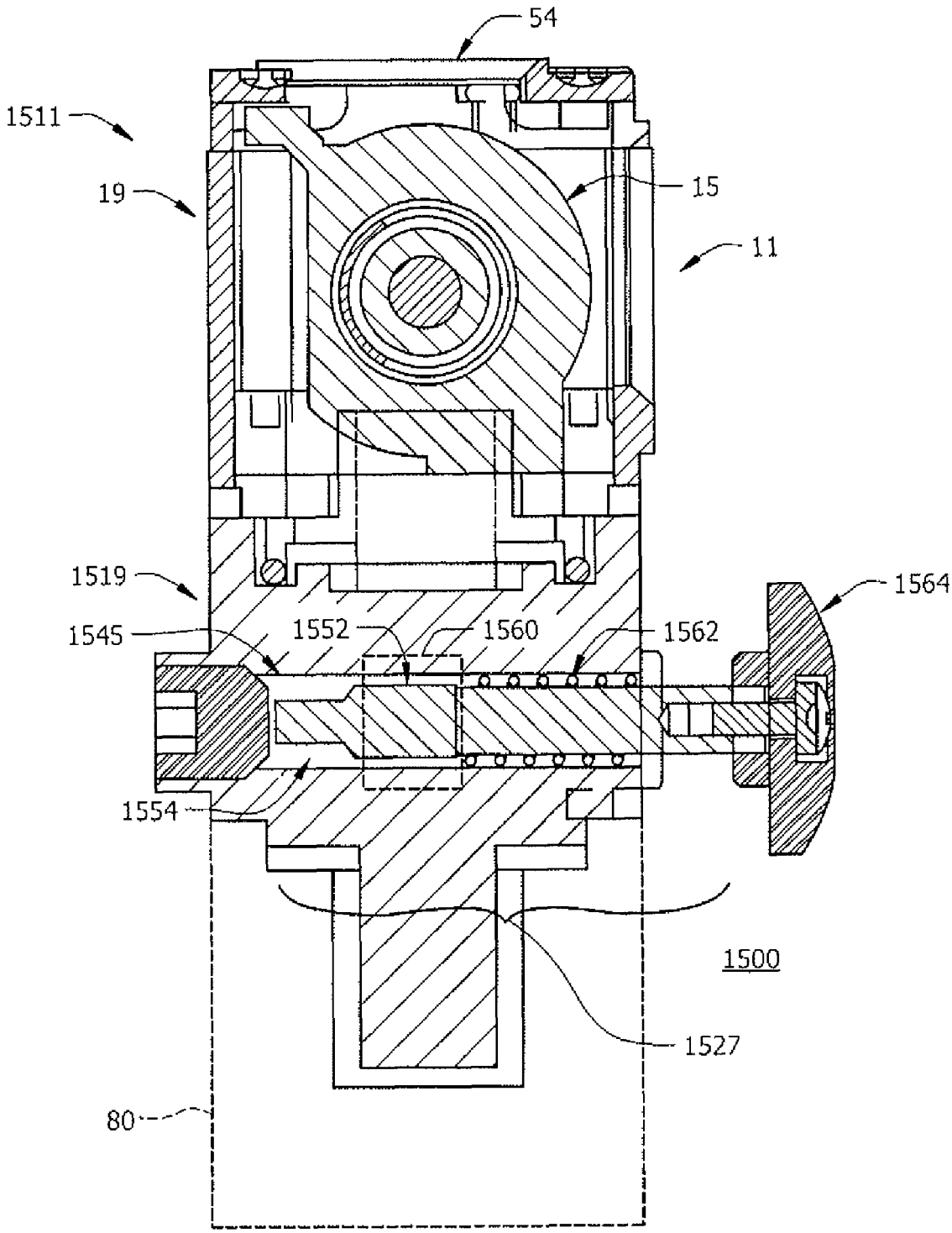
FIG. 15 is a cross section of the operating head according to an alternate embodiment of the present invention.

FIG. 15 shows a cross section of safety switch 1500 having an operating head 1511 and a switch housing 80, according to another embodiment of the present invention. The operating head 1511 can include a cam housing 19, as described above for operating head 11 in FIGS. 1-13, and an alternate securing housing 1519, according to another embodiment of the present invention. In FIG. 15, rather than requiring an operator to press a button to release the plunger, the operator can be required to pull on button 1564. In such embodiments, the securing housing 1519 can be configured to include a securing member cavity 1545 and an intersecting portion 1560 between the securing member cavity 1545 and a plunger cavity (not shown), as described above. In these embodiments, the securing member 1527 can be configured for pulling by essentially exchanging the positions of the spring member 1562 and the annular shoulder portion 1554 of the securing member 1527. However, the spring member 1562 still automatically repositions the cylindrical portion 1552 of the securing member 1527 in the intersecting portion 1560 of the securing housing when the annular shoulder portion of the plunger (not shown) is in the intersecting portion 1560. That is, in the case of a compression spring, the force of the spring member 1562 causes motion of the securing member 1527 when the securing member 1527 can be free to move in the securing member cavity 1545. Thus, the securing member 1527, repositioned into the intersecting region 1560, allows no further motion of the plunger.

Afterwards, to release the plunger and remove a key from the cam housing 19, force can be exerted by an operator on the securing member 1527 by pulling on the button 1564. The force compresses the spring member 1545 between the cylindrical portion 1552 and a wall of the securing housing 1519, allow the annular shoulder portion 1554 of the securing member 1527 to be repositioned in the intersecting portion 1560 of the securing housing 1519. In such embodiments an end of the cylindrical portion 1552 can be configured as a detent for compressing the spring member 1562 or a separate detent can be provided in the securing member. Accordingly, as described above, motion of the plunger can be permitted, allowing the operator to remove a key and dc-energize the device.

In some embodiments, the "pull" mechanism used for securing housing 1519 in FIG. 15 can be adapted to provide alternative configurations of the securing housing. Exemplary configurations of these alternate embodiments are illustrated in FIGS. 16 and 17.

Figure 16:
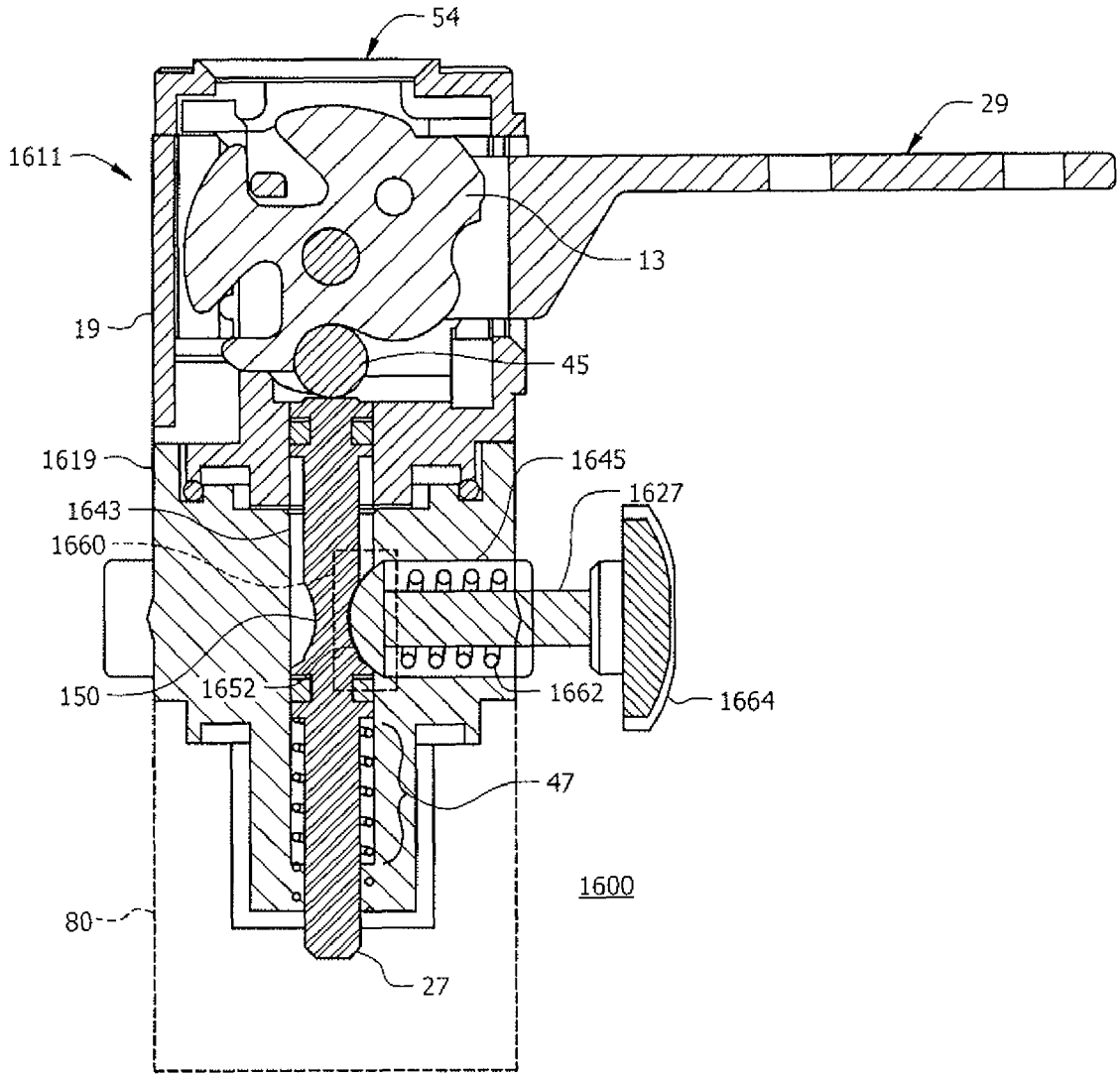
FIG. 16 is a cross section of an operating head according to another alternate embodiment of the present invention.

FIG. 16 shows another alternate embodiment of a safety switch 1600 including a switch housing 80 and an operating head 1611 including a securing housing 1619. In securing housing 1619, the securing member cavity 1645 extends into the securing housing 1619 to the plunger cavity 1643. In such embodiments, a contacting end 1652 of a securing member 1627 can be configured to engage with the annular shoulder portion 150 of the plunger 27 in an intersecting region 1660. Furthermore, the spring member 1662 can be configured to automatically reposition the end portion 1652 of the securing member 1627 in the intersecting portion 1660 of the securing housing when the annular shoulder portion 150 of the plunger 27 is in the intersecting portion 1660. That is, in the case of a compression spring, the force of the spring member 1662 causes motion of the securing member 1627 when the securing member 1627 is free to move in the securing member cavity 1645. As described above, securing members can include one or more detents for providing compression of a spring member. Accordingly, by forcing the end portion 1652 of the securing member 1627 to be repositioned into the intersecting region 1660, no further motion of the plunger 27 is allowed.

Afterwards, to release the plunger 27 and remove the key 29 from the cam housing 19, force can be exerted by an operator on the securing member 1627 by pulling on the button 1664. The force compresses the spring member 1662 between the end portion 1652 and a wall of the securing housing 1619, removing the end portion 1652 from the intersecting portion 1660 of the securing housing 1619. Accordingly, motion of the plunger 27 is permitted, allowing the operator to remove the key 29 and de-energize the device.

Figure 17:
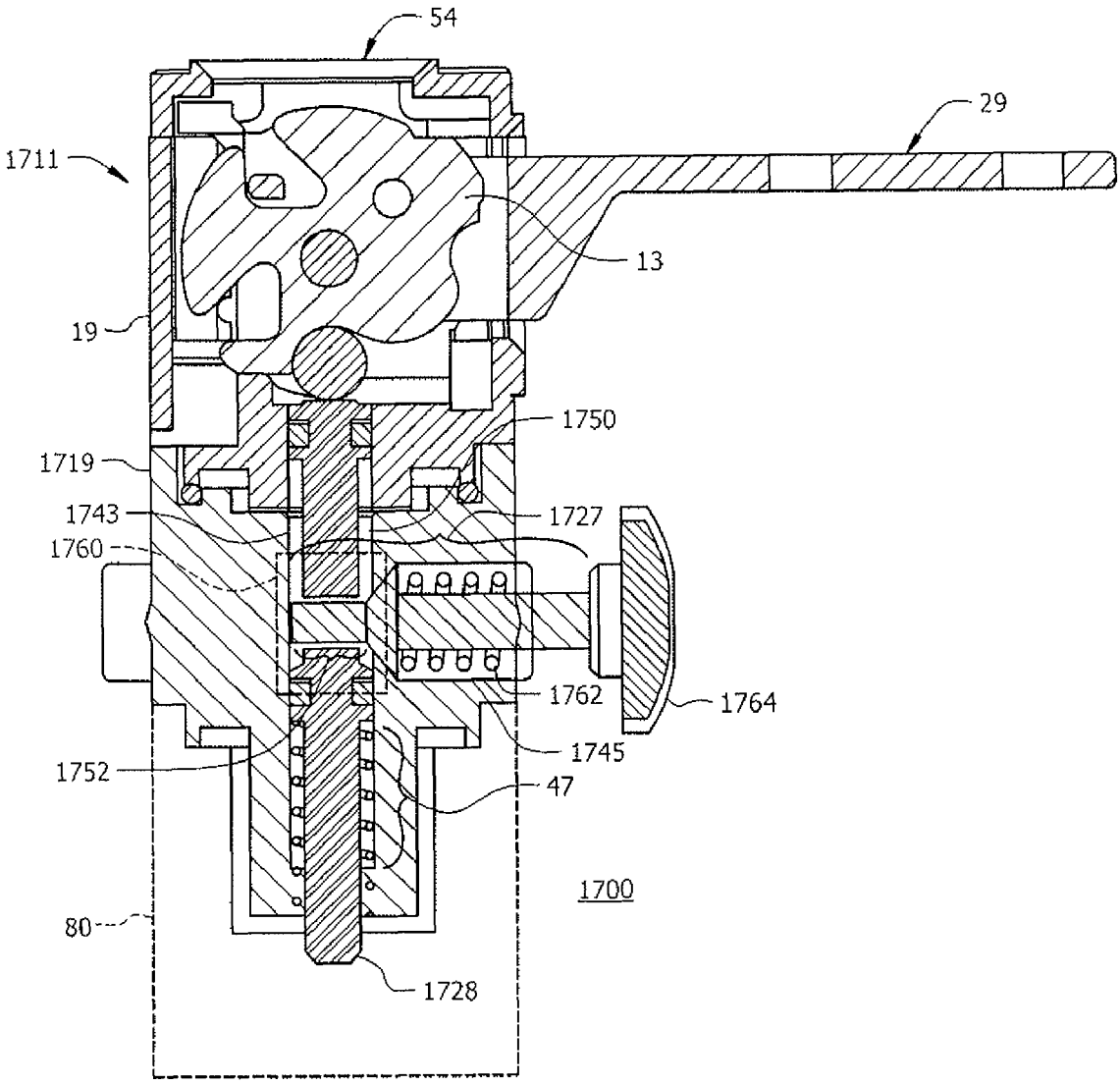
FIG. 17 is a cross section of an operating head according to yet another alternate embodiment of the present invention.

FIG. 17 shows yet another alternate embodiment of a safety switch 1700 including a switch housing 80 and an operating head 1711 including a securing housing 1719. In FIG. 17, the securing housing 1719 also can have a securing member cavity 1745 that extends only to the plunger cavity 1743. In such embodiments, rather than providing an annular shoulder portion for the plunger 1728, the plunger 1728 can include an opening 1750 for insertion of a contacting end 1752 of a securing member 1727. As previously described, maintaining alignment of the opening 1750 and the contacting end 1752 can require additional alignment structures in the plunger 1728 or the securing housing 1719. In operation, the spring member 1762 can be configured to automatically reposition the end portion 1752 of the securing member 1727 into the opening 1750 of the plunger 1727 when the opening 1750 is in the intersecting portion 1760. That is, in the case of a compression spring, the force of the spring member 1762 causes motion of the securing member 1727 when the securing member 1727 is free to move in the securing member cavity 1745. Accordingly, by forcing the end portion 1752 of the securing member 1727 to be inserted into opening 1750 of the plunger 1728, no further motion of the plunger 1728 is allowed.

Afterwards, to release the plunger 1728 and remove the key 29 from the cam housing 19, force can be exerted by an operator on the securing member 1727 by pulling on the button 1764. The force compresses the spring member 1762 between the end portion 1752 and a wall of the securing housing 1719, removing the end portion 1752 from the opening 1750. Accordingly, motion of the plunger 1728 is permitted, allowing the operator to remove the key 29 and de-energize the device.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention can have been illustrated and described with respect to one or more implementations, equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (e.g., that can be functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "can have", "with", or variants thereof are used in either the detailed description and/or the claims, such terms are intended to be inclusive in a manner similar to the term "comprising."

What is claimed is:

1. An operating head for a safety switch comprising:

a key-operated cam mechanism;

a plunger contacting said cam mechanism and extending from said cam mechanism along a first path, said plunger displaceable between first and second positions along said first path responsive to said cam mechanism; and at least one securing member interacting with said plunger, said securing member displaceable between a locked and a released position, and comprising a shaft positioned along a second path intersecting said first path at an intersection, wherein displacement of the securing member to said released position allows movement of the plunger in said first path, wherein displacement of the plunger to said second position causes displacement of said securing member from said released position to said locked position, wherein said locked position secures said plunger in said second position, and wherein said shaft has a shaft surface profile comprising at least a first shoulder, said first shoulder dimensioned to allow displacement of said plunger between said first and said second positions when said first shoulder is positioned in said intersection.

2. The operating head of claim 1, wherein said first and said second paths are substantially perpendicular.

3. The operating head of claim 1, wherein said plunger has a plunger surface profile comprising at least a second shoulder, said second shoulder dimensioned to allow said displacement of said shaft between said released and said locked positions when said second shoulder is positioned in said intersection.

4. The operating head of claim 3, wherein said displacement of said plunger to said second position places said second shoulder in said intersection.

5. The operating head of claim 4, wherein said securing mechanism further comprises a spring mechanism for automatically displacing said shaft to said locked position responsive to said second shoulder being placed in said intersection.

6. The operating head of claim 3, wherein said second shoulder comprises an annular shoulder.

7. The operating head of claim 1, wherein said first shoulder comprises an annular shoulder.

8. The operating head of claim 1, wherein said plunger has an opening extending through a width of said plunger, said opening dimensioned to allow insertion of said shaft into said opening when said opening is positioned in said intersection.

9. A safety switch comprising:

a cam housing, said cam housing having a key-operated cam mechanism;

a securing housing coupled to said cam housing in one or more positions;

a switch housing coupled to said securing housing in one or more positions, said switch housing having a switch mechanism;

a plunger contacting said cam mechanism and said switch mechanism, said plunger extending through said securing housing along a first path, said plunger displaceable between first and second positions along said first path responsive to said cam mechanism, said plunger displacement actuating said switch mechanism;

at least one securing member extending through at least a portion of said securing housing and interacting with said plunger within said securing housing, said securing member displaceable between a locked and a released position, and comprising a shaft positioned along a second path intersecting said first path at an intersection, wherein displacement of the securing member to said released position allows movement of the plunger in said first path, wherein displacement of the plunger to said second position causes displacement of said securing member from said released position to said locked position, wherein said locked position secures said plunger in said second position, and wherein said shaft has a shaft surface profile comprising at least a first shoulder, said first shoulder dimensioned to allow said displacement of said plunger between said first and said second positions when said first shoulder is positioned in said intersection.

10. The safety switch of claim 9, wherein said first and said second paths are substantially perpendicular.

11. The safety switch of claim 9, wherein said plunger has a plunger surface profile comprising at least a second shoulder, said second shoulder dimensioned to allow said displacement of said shaft between said released and said locked positions when said second shoulder is positioned in said intersection.

12. The safety switch of claim 11, wherein said displacement of said plunger to said second position places said second shoulder in said intersection.

13. The safety switch of claim 12, wherein said securing mechanism further comprises a spring mechanism for automatically displacing said shaft to said locked position responsive to said second shoulder being placed in said intersection.

14. The safety switch of claim 11, wherein said second shoulder comprises an annular shoulder.

15. The safety switch of claim 9, wherein said second first shoulder comprises an annular shoulder.

16. A safety enclosure, comprising:

a first enclosure portion having a key-operated safety switch; and a second enclosure portion for engaging said first enclosure portion, said second enclosure having a key for said safety switch, said key oriented to engage said safety switch during engagement of said first and said second enclosure portions, wherein said safety switch comprises:

a key-operated cam mechanism, a switch mechanism, a plunger contacting said cam mechanism and extending from said cam mechanism to said switch mechanism along a first path, said plunger displaceable between first and second positions along said first path responsive to said cam mechanism to actuate said switch mechanism, and at least one securing member interacting with said plunger, said securing member displaceable between a locked and a released position, and comprising a shaft positioned along a second path intersecting said first path at an intersection, wherein displacement of the securing member to said released position allows movement of the plunger in said first path, wherein displacement of the plunger to said second position causes displacement of said securing member from said released position to said locked position, wherein said locked position secures said plunger in said second position, and wherein said shaft has a shaft surface profile comprising at least a first shoulder, said first shoulder dimensioned to allow displacement of said plunger between said first and said second positions when said first shoulder is positioned in said intersection.

* * * * *

UNITED STATES PATENT AND TRADEMARK OFFICE

CERTIFICATE OF CORRECTION

PATENT NO. : 8,017,880 B2
APPLICATION NO. : 12/147228
DATED : September 13, 2011
INVENTOR(S) : Eisenhower, Jr. et al.

It is certified that error appears in the above-identified patent and that said Letters Patent is hereby corrected as shown below:

Column 12, line 26, "said second first" should be changed to --said first--.

Signed and Sealed this
Twenty-eighth Day of February, 2012

David J. Kappos

David J. Kappos
*Director of the United States Patent and Trademark Office*